United States Patent [19]

Vatsky et al.

[11] Patent Number: 4,497,263

[45] Date of Patent: Feb. 5, 1985

[54] COMBUSTION SYSTEM AND METHOD FOR A COAL-FIRED FURNACE UTILIZING A WIDE TURN-DOWN BURNER

[75] Inventors: Joel Vatsky, Millburn; Edmund S. Schindler, Maplewood, both of N.J.

[73] Assignee: Foster Wheeler Energy Corporation, Livingston, N.J.

[21] Appl. No.: 472,807

[22] Filed: Mar. 7, 1983

[51] Int. Cl.[3] ..... F23K 3/02

[52] U.S. Cl. ..... 110/347; 110/106; 110/264; 55/442

[58] Field of Search ..... 110/261-265, 110/106 R, 347; 55/442, 444

[56] References Cited

U.S. PATENT DOCUMENTS

| | | | |
|---|---|---|---|
| 408,285 | 8/1889 | Boehning | 55/442 |
| 2,506,273 | 5/1950 | Linderoth | 55/444 |
| 2,876,862 | 3/1959 | Hummel | 55/444 |
| 3,155,474 | 11/1964 | Sexton | 55/442 |
| 3,757,892 | 9/1973 | Randman, Jr. | 55/442 |
| 3,899,960 | 8/1975 | Howells | 98/37 |
| 3,958,966 | 5/1976 | Keller | 55/442 |
| 4,123,241 | 10/1978 | Maden | 55/442 |
| 4,147,116 | 4/1979 | Graybill | 110/264 |
| 4,241,673 | 12/1980 | Smith et al. | 110/264 |
| 4,249,470 | 2/1981 | Vatsky | 110/264 |
| 4,274,343 | 6/1981 | Kokkinos | 110/347 |

*Primary Examiner*—Henry C. Yuen

*Attorney, Agent, or Firm*—Marvin A. Naigur; John E. Wilson; Warren B. Kice

[57] ABSTRACT

A combustion system and method for a coal-fired furnace in which a burner divides a mixture of coal and air into a first stream containing most of the coal and a second stream containing most of the air. The first stream is discharged from the central part of the burner and the second stream is discharged through an annular passage surrounding the first stream in a combustion-supporting relation to the first stream. Additional air is discharged in varying amounts in a combustion-supporting relation to said streams.

17 Claims, 4 Drawing Figures

COMBUSTION SYSTEM AND METHOD FOR A COAL-FIRED FURNACE UTILIZING A WIDE TURN-DOWN BURNER

BACKGROUND OF THE INVENTION

This invention relates to a combustion system and method for a coal-fired furnace and, more particularly, to such a system and method which utilizes coal as the primary fuel and combusts a coal-air mixture.

In a typical coal-fired furnace, particulate coal is delivered in suspension with primary air from a pulverizer, or mill, to the coal burners, or nozzles, and a secondary air is provided to supply a sufficient amount of air to support combustion. After initial ignition, the coal continues to burn due to local recirculation of the gases and flame from the combustion process.

In these types of arrangements, the coal readily burns after the furnace has been operating over a fairly long period of time. However, for providing ignition flame during startup and for warming up the furnace walls, the convection surfaces and the air preheater; the mixture of primary air and coal from conventional main nozzles is usually too lean and is not conducive to burning under these relatively cold circumstances. Therefore, it has been the common practice to provide oil or gas fired ignitors and/or guns for warming up the furnace walls, convection surfaces and the air preheater, since these fuels have the advantage of a greater ease of ignition and, therefore, require less heat to initiate combustion. The ignitors are usually started by an electrical sparking device or swab, and the guns are usually lit by an ignitor or by a high energy or high tension electrical device.

Another application of auxiliary fuels to a coal-fired furnace is during reduced load conditions when the coal supply, and, therefore, the stability of the coal flame, is decreased. Under these conditions, the oil or gas ignitors and/or guns are used to maintain flame stability in the furnace and thus avoid accumulation of unburned coal dust in the furnace.

However, in recent times, the foregoing advantages of oil or gas fired warmup and low load guns have been negated by the increasing costs and decreasing availability of these fuels. This situation is compounded by the ever-increasing change in operation of coal-fired nozzles from the traditional base-loaded mode to that of cycling, or shifting, modes which place even heavier demands on supplemental oil and gas systems to support these types of units.

To alleviate these problems, it has been suggested to form a dense phase particulate coal by separating air from the normal mixture of pulverized coal and air from the mill and then introducing the air into a combustion supporting relation with the resulting dense phase particulate coal as it discharges from its nozzle. However, this has required very complex and expensive equipment externally of the nozzle to separate the coal and transport it in a dense phase to the nozzle.

SUMMARY OF THE INVENTION

It is, therefore, an object of the present invention to provide a combustion system and method for a coal-fired furnace which will substantially reduce or eliminate the need for supplementary fuel, such as oil or gas, to achieve warmup, startup and low load stabilization.

It is a further object of the present invention to provide a system and method of the above type in which a more dense particulate coal stream is provided which is ignited for use during startup, warmup and low load conditions.

It is a still further object of the present invention to provide a system and method of the above type in which a dense particulate coal stream is formed by separating air from the normal mixture of pulverized coal and air from the pulverizer and then introducing the air in a combustion supporting relation with the resulting dense particulate coal stream as it discharges from its nozzle, without the need for complex and expensive external equipment.

It is a still further object of the present invention to provide a system and method of the above type in which a burner is provided for receiving a mixture of coal and air and for separating the coal from the air and discharging both in a combustion-supporting relationship.

It is a still further object of the present invention to provide a system and method of the above type in which the aforementioned burner is adapted for use over a full range of operating conditions.

Toward the fulfillment of these and other objects, the present invention includes a burner for receiving a stream of particulate coal and air, and for forming a first mixture containing most of the coal and a second mixture containing most of the air, and for discharging same in a combustion supporting relationship. Secondary air is discharged towards the two mixtures in a combustion-supporting relationship.

BRIEF DESCRIPTION OF THE DRAWINGS

The above brief description, as well as further objects, features and advantages of the present invention will be more fully appreciated by reference to the following detailed description of a presently preferred but, nonetheless, illustrative embodiment in accordance with the present invention, when taken in conjunction with the accompanying drawings wherein.

DESCRIPTION OF THE PREFERRED EMBODIMENT

Figure 1:
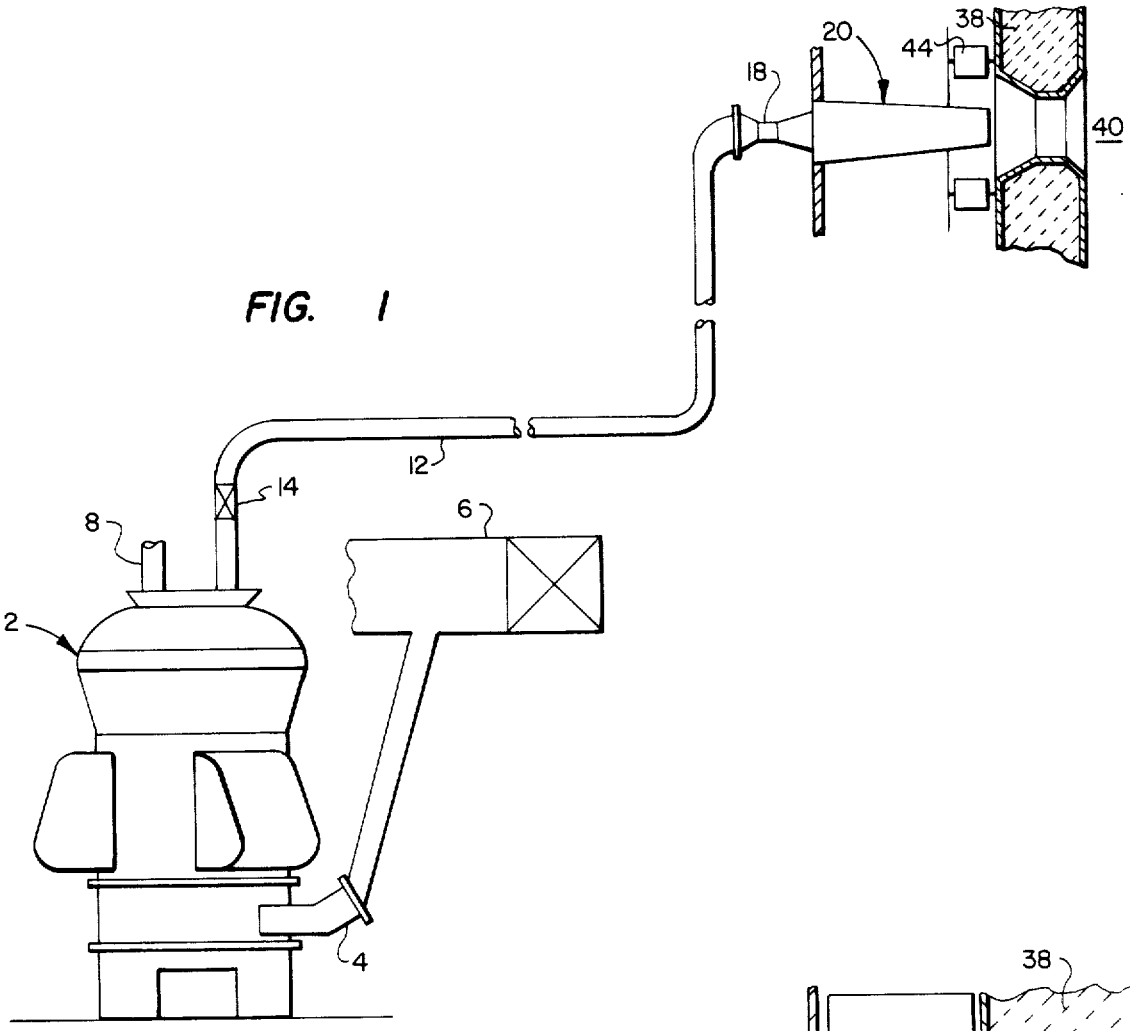
FIG. 1 is a schematic diagram depicting the combustion system of the present invention.

Referring specifically to FIG. 1 of the drawings, the reference numeral 2 refers in general to a mill, or pulverizer, which has an inlet 4 for receiving air from a primary air duct 6, it being understood that the latter duct is connected to an external source of air and that a heater, or the like can be provided in the duct for preheating the air. The mill 2 has an inlet 8 for receiving raw coal from an external source, it being understood that both the air and coal are introduced into the mill under the control of a load control system, not shown.

The mill 2 operates in a conventional manner to dry and grind the coal into relatively fine particles, and has an outlet located in its upper portion which is connected to one end of a conduit 12 for receiving the mixture of pulverized coal and air. A shutoff valve 14 is provided in the conduit 12 and controls the flow of the coal/air mixture to a convergent-divergent conduit section 18 connected to the other end of the conduit 12. It is understood that, although only one conduit 12 is shown in detail in the interest of clarity, the mill 2 will have several outlets which connect to several conduits 12, which, in turn, are connected to several conduit sections 18, with the number of outlets, conduits, and conduit sections corresponding in number to the number of burners, or nozzles, utilized in the particular furnace.

Figure 2:
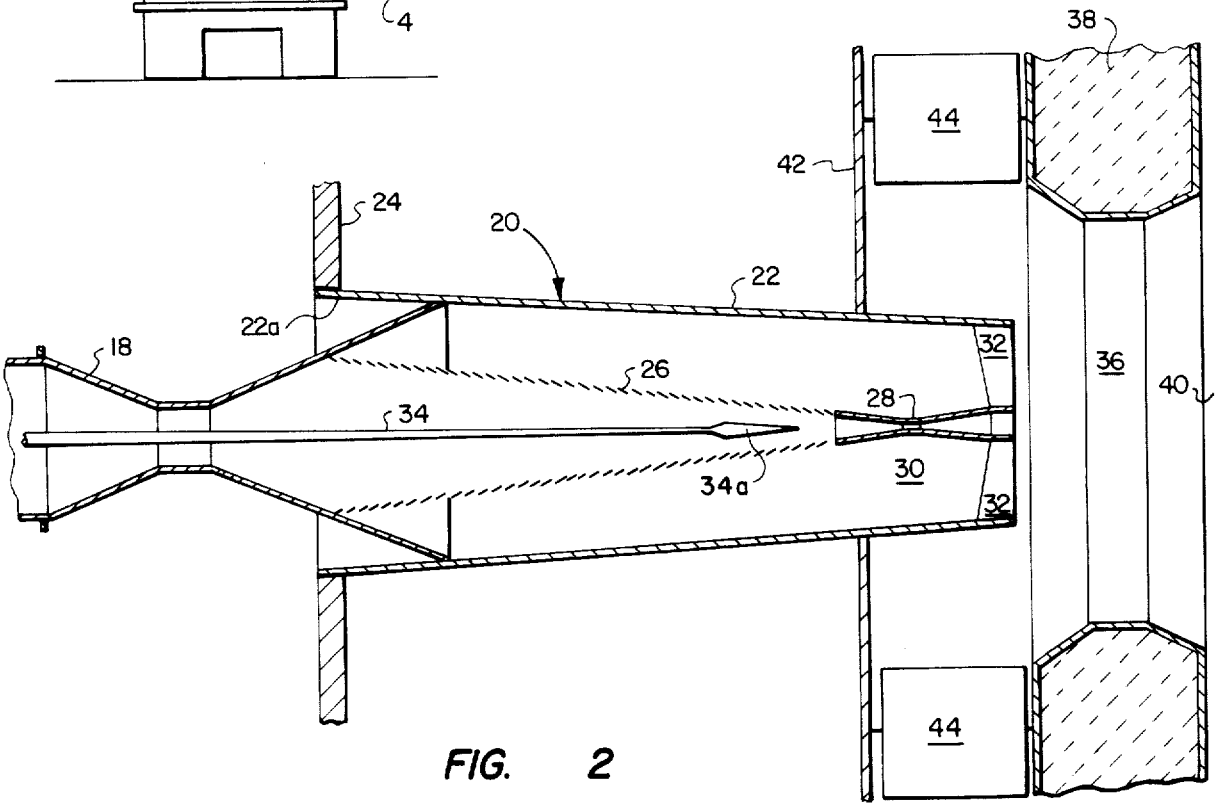
FIG. 2 is an enlarged cross-sectional view of the separator-nozzle depicted in FIG. 1.

The conduit section 18 is connected to a burner, shown in general by the reference numeral 20 and depicted in detail in FIG. 2. The burner includes an elongated housing 22 having an inlet 22*a* at one end thereof for receiving the conduit section 18, with the latter end of the housing 22 being supported in an opening formed in a vertical wall 24. A cone 26 extends within the housing 22 for substantially the entire length thereof and is formed by a plurality of spaced louvers extending in a parallel relationship along the axis of the cone. Although not clear from the drawings, it is understood that several circumferentially spaced rows of louvers extend around the cone 26, with solid wall portions of the cone extending between adjacent rows. A relatively short convergent-divergent discharge tube 28 extends from the other end of the cone 26 and flush with the other end of the housing 22. An annular chamber 30 is defined between the housing 22 and the assembly formed by the cone 26 and the tube 28, and a plurality of swirler blades 32 are disposed at the discharge end of the chamber 30, for reason to be explained later.

An elongated rod 34 extends along the axes of the conduit section 18 and the cone 26, and is adapted to move in an axial direction relative thereto. The rod 34 has a tapered head portion 34*a* which, together with the corresponding inner wall portions of the cone 26 and the discharge tube 28, defines an annular passage the size of which can be varied by adjusting the longitudinal position of the rod 34 relative to the cone 26 and the tube 28, so as to vary the mass flow of the mixture of coal and air, which is primarily coal as discussed above, into the discharge tube 28. It is understood that the rod 34 extends externally of the burner 20 and is connected to a control system (not shown) for varying its position.

The burner 20 is disposed in axial alignment with a through opening 36 formed in a front wall 38 of a conventional furnace forming, for example, a portion of a steam generator. Although not shown in the drawing, it is understood that the furnace includes a back wall and a side wall of an appropriate configuration to define a combustion chamber 40 immediately adjacent the opening 36. The front wall 38, as well as the other walls of the furnace include an appropriate thermal insulation material and, while not specifically shown, it is understood that the combustion chamber 40 can also be lined with boiler tubes through which a heat exchange fluid, such as water, is circulated in a conventional manner for the purpose of producing steam.

The vertical wall 24 is disposed in a parallel relationship with the furnace wall 38, it being understood that top, bottom, and side walls (not shown) are also provided which, together with the wall 24, form a phenum chamber, or wind box, for receiving combustion supportng air, commonly referred to as "secondary air", in a conventional manner.

An annular plate 42 extends around the housing 22 and between the front wall 38 and the wall 24, and a plurality of register vanes 44 are pivotally mounted between the front wall 38 and the plate 42 to control the swirl of secondary air passing from the wind box to the opening 36. It is understood that, although only two register vanes 44 are shown in FIG. 1, several more vanes extend in a circumferentially spaced relation to the vanes shown. Also, the pivotal mounting of the vanes 44 may be done in any conventional manner, such as by mounting the vanes on shafts (shown schematically) and journalling the shafts in proper bearings formed in the front wall 38 and the plate 42, with the position of the vanes 44 being adjustable by means of cranks or the like. Since these types of components are conventional, they are not shown in the drawings nor will be described in any further detail.

Although not shown in the drawings for the convenience of presentation, it is understood that various devices can be provided to produce ignition energy for a short period of time to the dense phase coal particles discharging from the burner 20 to ignite the particles. For example, a high energy sparking device in the form of an arc ignitor or a small oil or gas conventional gas ignitor can be supported by the burner 20.

Assuming the furnace discussed above forms a portion of a vapor generator and it is desired to start up the generator, air is introduced into the inlet 4, and a relatively small amount of coal is introduced to the inlet 8 of the mill 2 which operates to crush the coal into a predetermined fineness. A relatively lean mixture of air and finely pulverized coal, in a predetermined proportion, is discharged from the mill 2 where it passes into and through the conduit 12 and the valve 14.

The coal-air mixture from the conduit 12 passes into and through the convergent-divergent conduit section 18 which causes the coal portion of the mixture to tend to take a central path through the latter section and into the cone 26 of the burner 20, and the air to tend to pass into the cone in a path surrounding the coal and nearer the louvered wall portion of the cone. The louvered design of the cone 26 sets up aerodynamic forces which allow the faster rushing air to escape through the spaces between the louvers while the more sluggish coal particles are trapped along each louver and are ultimately drawn towards the discharge end of the cone and into the tube 28. As a result, during its passage through the cone 26, that portion of the coal passing near the louvered portion of the cone takes the path shown by the solid flow arrows in FIG. 3, i.e. it tends to pass off of the louvers and back towards the central portion of the cone; while the air tends to pass through the spaces between the louvers and into the annular chamber 30 between the cone 26 and the housing 22, as shown by the dashed arrows. As a result, a dense phase particulate coal stream having a high coal-to-air ratio, discharges from the discharge tube 28 (FIG. 2) of the cone 26 and the air discharges from the chamber 30 and is swirled by the swirler blades 32. It is noted that, although only two swirler blades 32 are shown in the drawing, several more blades would be disposed in a spaced relation around the chamber 30 so that a relatively high swirl of the air discharging from the latter chamber can be achieved to develop a short flame that can be varied over a wide range of turndown. Also, although not clear from the drawings, the swirler blades 32 are adjustable to allow greater control of the flame shape and stability. The coal and air thus intermix and recirculate in front of the discharge tube 28 as a result of the swirl imparted to the air by the swirler blades 32 and the resulting reverse flow effect of the vortex formed. This results in a rich mixture which can readily be ignited by one of the techniques previously described, such as, for example, directly from a high energy spark, or an oil or gas ignitor. Although the coal output from the mill 2 is low, the concentration of the coal results in a rich mixture which is desirable and necessary at the point of ignition. The vortex so formed by this arrangement produces the desired recirculation of the products of combustion of the burning coal to provide heat energy to ignite the new coal as it enters the ignition zone. The flame size can be controlled by longitudinal adjustment of the rod 34 and the vanes 44 can be adjusted as needed to provide secondary air to the combustion process to aid in flame stability.

As loading increases, the flow to each burner 20 increases and/or more separator-nozzle assemblies and/or mills are placed into service as needed, while the vanes 44 are opened to increase the flow of secondary air in proportion to the increase in the amount of coal discharging from the discharge tube 28.

Several advantages result from the foregoing. For example, during startup the energy expenditures from an ignitor occurs only for the very short time needed to directly ignite the dense particulate coal stream from the burner 20, after which the coal can maintain a self-sustaining flame. Thus, startup and warmup can be completed solely by the combustion of the dense particulate coal stream as assisted by the swirling air from the chamber 36 which can develop a short flame that can be varied over a wide range of turndown. Also, each burner 20 is operable over a full range of operating conditions including, start-up, low load and full load, while eliminating the need for complex and expensive external equipment, including separators, fans, structural supports and conduits.

The system and method described herein can be adapted to most existing systems and any new installation since the flow is divided in various parallel paths and additional pressure losses are kept to a minimum.

Figure 3:
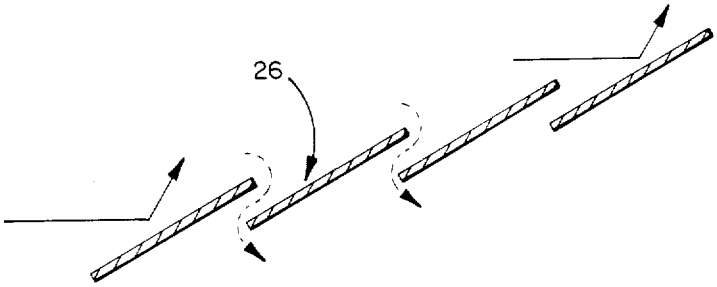
FIG. 3 is a partial, enlarged cross-sectional view of a portion of the separator-nozzle assembly of FIG. 2.
Figure 4:
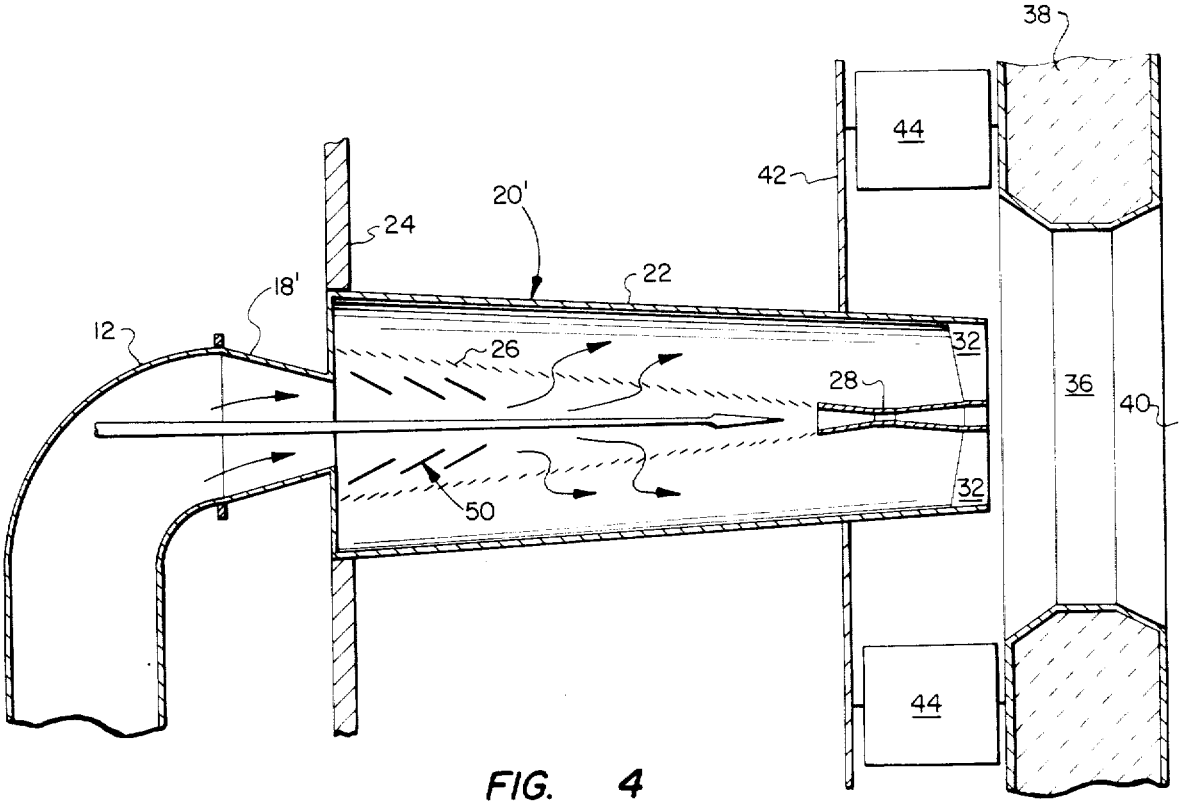
FIG. 4 is a view similar to FIG. 2 but depicting an alternate embodiment of the present invention.

The embodiment of FIG. 4 is similar to that of FIGS. 1-3 and identical structure is referred to by the same reference numerals.

According to the embodiment of FIG. 4, a burner 20' is provided in which a conical conduit section 18' connects the conduit 12 to the cone 26, and a relatively short, louvered cone 50 is provided within the inlet end portion of the cone 26. The louvers forming the cone 50 are larger than those forming the cone 26 and cooperate with the conical conduit section 18' to centralize the flow of coal and to effect an initial separation of the coal portion of the coal-air mixture entering the conduit section 18' from the air portion. Otherwise, the operation of the system of the embodiment of FIG. 4 is identical to that of the embodiment of FIGS. 1-3.

It is understood that the present invention is not limited to the specific arrangement disclosed above but can be adapted to other configurations as long as the foregoing results are achieved.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. A system for combusting a coal-air mixture comprising an inner member; an outer member extending around said inner member and defining therewith a chamber surrounding said inner member, said inner member comprising an inlet end portion for receiving said mixture, a discharge end portion, and means for separating said mixture into a first stream and a second stream and for directing said first stream in an axial direction through said inner member and said second stream into said chamber; and means for varying the flow of said first stream through said inner member; said outer member having an open end defining an outlet for discharging said second stream from said chamber in a pattern surrounding said first stream and in a combustion-supporting relation to said first stream.

2. The system of claim 1 wherein said varying means comprises a rod movable within said inner member, said rod and said inner member being configured so that movement of said rod varies the effective area of the flow path of said first stream.

3. The system of claim 1 wherein said second stream discharges from said tubular member through a plurality of openings formed through said inner member.

4. The system of claim 1 wherein said separating means comprises a plurality of spaced louvers formed in the wall portion of said inner member extending between said end portions, said louvers being constructed and arranged to set up aerodynamic forces causing the air to tend to pass through the spaces between said louvers and into said annular chamber, and the coal to tend to concentrate around said louvers before passing through said discharge end portion.

5. The system of claim 1 further comprising means for discharging additional air in a combustion supporting relation to said first and second streams.

6. The system of claim 5 wherein said additional air discharging means comprises a plurality of air vanes extending around said discharge end portion for discharging said additional air around said second stream.

7. The system of claim 6 wherein the position of said vanes are adjustable to vary the amount of additional air discharged.

8. The system of claim 1 further comprising swirler means disposed at the discharge end of said chamber for imparting a swirl to said second stream.

9. The system of claim 8 wherein the position of said swirler means is adjustable to control the shape and stability of the flame formed as a result of said combustion.

10. A method of combusting a coal-air mixture utilizing a burner having an inlet and at least one outlet, comprising the steps of passing said mixture to said inlet, separating the mixture in said burner into a first stream containing substantially coal and a second stream containing substantially air, varying the flow of said first stream through said burner, discharging said first stream from said outlet in a substantially axial direction, discharging said second stream from said outlet in a pattern surrounding said first stream and in a combustion-supporting relationship to said first stream, and providing additional air in a combustion-supporting relation to said streams.

11. The method of claim 10 wherein said burner has two outlets from which first stream and said second stream are respectively discharged.

12. The method of claim 10 wherein said step separating comprises the step of passing said one stream within a louvered wall in said burner so that the coal portion of said one stream tends to collect on said louvers and the air portion of said one stream tends to pass between said louvers.

13. The method of claim 12 wherein said step of separating further comprises the step of discharging said air portion into an annular passage formed within said burner.

14. The method of claim 13 further comprising the step of imparting a swirl to said air portion as it discharges from said annular passage.

15. The method of claim 14 wherein said air portion is discharged around said coal portion.

16. The method of claim 15 wherein said additional air is discharged around said air portion.

17. The method of claim 10 wherein said step of varying comprises the step of varying the effective area of the flow path of said first stream.

* * * * *